US009265355B1

(12) United States Patent
Tramontana

(10) Patent No.: US 9,265,355 B1
(45) Date of Patent: Feb. 23, 2016

(54) INFLATABLE FURNITURE COVER SUPPORT

(71) Applicant: Paul Tramontana, Matawan, NJ (US)

(72) Inventor: Paul Tramontana, Matawan, NJ (US)

( * ) Notice: Subject to any disclaimer, the term of this patent is extended or adjusted under 35 U.S.C. 154(b) by 23 days.

(21) Appl. No.: 14/192,646

(22) Filed: Feb. 27, 2014

(51) Int. Cl.
*A47G 11/00* (2006.01)
*A47C 31/10* (2006.01)

(52) U.S. Cl.
CPC ..... *A47C 31/10* (2013.01)

(58) Field of Classification Search
CPC ... A47G 11/008; A47G 11/081; A47C 27/081
USPC ..... 150/158, 901; 206/522; 108/57.12, 90; 137/223; 248/346.2; 5/655.3; 297/461
See application file for complete search history.

(56) References Cited

U.S. PATENT DOCUMENTS 750,571 A * 1/1904 Berger ..... A47C 27/081 297/199
RE15,708 E * 10/1923 Laidman ..... 160/230
2,754,888 A * 7/1956 La Palme ..... A47C 5/046 297/1
3,279,515 A * 10/1966 Kesh ..... 108/90
3,353,867 A * 11/1967 Anderson ..... 297/228.13
3,426,891 A * 2/1969 Marks ..... 410/119
3,455,605 A * 7/1969 Anderson ..... A47C 5/12 297/440.18
4,750,402 A * 6/1988 Markey ..... 84/453
4,838,613 A * 6/1989 Smith ..... A47C 4/54 297/452.41
5,004,296 A * 4/1991 Ziegenfuss, Jr. ..... A47C 15/006 297/188.14
5,392,477 A 2/1995 Wolter et al.
5,594,190 A * 1/1997 Malta ..... 84/453
5,645,319 A * 7/1997 Parks, Jr. ..... A47C 7/383 297/146
5,694,866 A * 12/1997 Muller ..... A47C 7/66 108/161
5,901,503 A 5/1999 Dalene et al.
5,901,850 A * 5/1999 Jones et al. ..... 206/522
6,901,617 B2 6/2005 Sprouse, II et al.
2004/0016485 A1* 1/2004 Muller ..... 150/158
2005/0168045 A1* 8/2005 Ku ..... A47C 4/54 297/452.41
2007/0051285 A1* 3/2007 French et al. ..... 108/90
2007/0204406 A1* 9/2007 Thisse ..... A47C 27/081 5/655.3
2008/0263772 A1* 10/2008 Chiu ..... A47C 4/54 5/654
2009/0038516 A1* 2/2009 Gerow ..... 108/50.11
2009/0193616 A1* 8/2009 Hendricks ..... A47B 97/00 16/30
2010/0326017 A1* 12/2010 Kindel ..... 53/461
2011/0139041 A1* 6/2011 Pappas et al. ..... 108/90

* cited by examiner

*Primary Examiner* — Sue A Weaver
(74) *Attorney, Agent, or Firm* — Crossley Patent Law

(57) ABSTRACT

An inflatable furniture cover support including an inflatable shell disposed atop an outdoor furniture item in order to support a furniture cover in a position covering the outdoor furniture item without touching the outdoor furniture item to prevent mildew and water stains on the furniture cover. An air intake-exhaust tube has a proximal end in fluid communication with an air chamber disposed within the shell and further has a distal end with an air intake-exhaust valve disposed thereon which is in operational communication with an air supply source to inflate and deflate the shell.

3 Claims, 3 Drawing Sheets

INFLATABLE FURNITURE COVER SUPPORT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of inflatable covers are known in the prior art. However, what is needed is an inflatable furniture cover support that includes an inflatable shell disposed atop an outdoor furniture item in order to support a furniture cover in a position covering the outdoor furniture item without touching the outdoor furniture item to prevent mildew and water stains on the furniture cover. An air intake-exhaust tube has a proximal end in fluid communication with an air chamber disposed within the shell and further has a distal end with an air intake-exhaust valve disposed thereon which is in operational communication with an air supply source to inflate and deflate the shell.

FIELD OF THE INVENTION

The present invention relates to removable inflatable covers for outdoor items, and more particularly, to an inflatable furniture cover support.

SUMMARY OF THE INVENTION

The general purpose of the present inflatable furniture cover support, described subsequently in greater detail, is to provide an inflatable furniture cover support which has many novel features that result in an inflatable furniture cover support which is not anticipated, rendered obvious, suggested, or even implied by prior art, either alone or in combination thereof.

To accomplish this, the present inflatable furniture cover support is devised to support a furniture cover as described herein, and alternately a protective cover already possessed by a user, slightly separated from outdoor furniture item to prevent mildew and water stains. The inflatable furniture cover support includes an inflatable shell. The inflatable shell includes a continuous airtight outer body having a top side, a flat bottom side, and a continuous outer perimeter disposed therebetween. An inflatable air chamber is continuously disposed within the outer body. The outer body top side has a size and a shape configured to cover only an entire top surface of an exposed horizontal portion of the outdoor furniture item. The outer body bottom side is removably disposed atop the top surface. The outer body bottom side further has a size extending from a center portion of the top surface to proximal an outer perimeter of the top surface. The outer body bottom side is configured to substantially conform to the top surface of the exposed horizontal portion of the outdoor furniture item. The shell is one of a dome-shape, a rectangular shape, and a square shape. An air intake-exhaust tube has a proximal end in fluid communication with the air chamber and further having a distal end with an air intake-exhaust valve disposed thereon. The valve is in operational communication with an air supply source, such as a manual foot air pump or an electric pump, to permit air flow into the tube and the air chamber to inflate the shell and alternately to permit air flow from the air chamber and the tube to deflate the shell. A grip member of the outer body is centrally disposed on center portion of the outer body to facilitate removal of the outer body from the top surface. The center portion of the outer body surrounds the grip member and has a height of approximately 12 inches.

A furniture cover can also be provided to work in conjunction with the shell, rather than a cover already possessed by the user. The furniture cover includes a waterproof, mildew resistant furniture cover body. The cover body has an upper portion disposed on the top side of the outer body and a lower portion having a size and a shape configured to cover an exposed side of a vertical portion of the outdoor furniture item. The shell is configured to support the furniture cover in a position covering the outdoor furniture item without touching the outdoor furniture item to prevent mildew and water stains on the furniture cover.

Thus has been broadly outlined the more important features of the present inflatable furniture cover support so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

With reference now to the drawings, and in particular FIGS. 1 through 5 thereof, an example of the instant inflatable furniture cover support employing the principles and concepts of the present inflatable furniture cover support and generally designated by the reference number 10 will be described.

Figure 1:
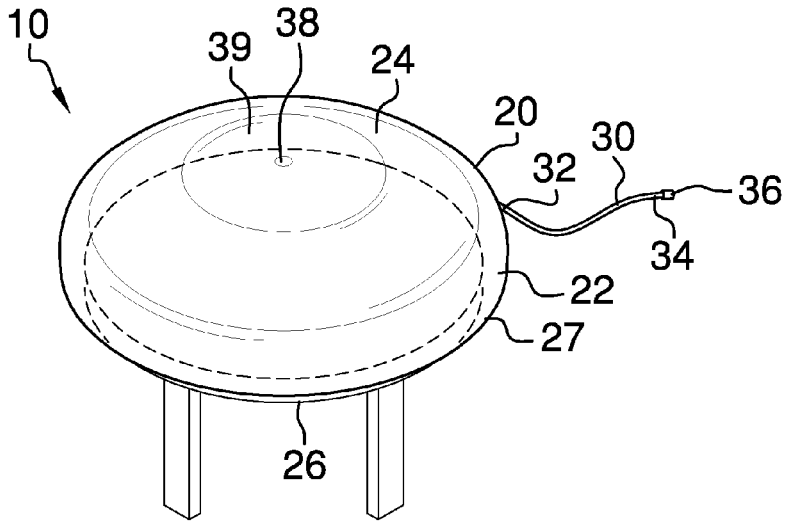
FIG. 1 is an isometric in-use view.
Figure 2:
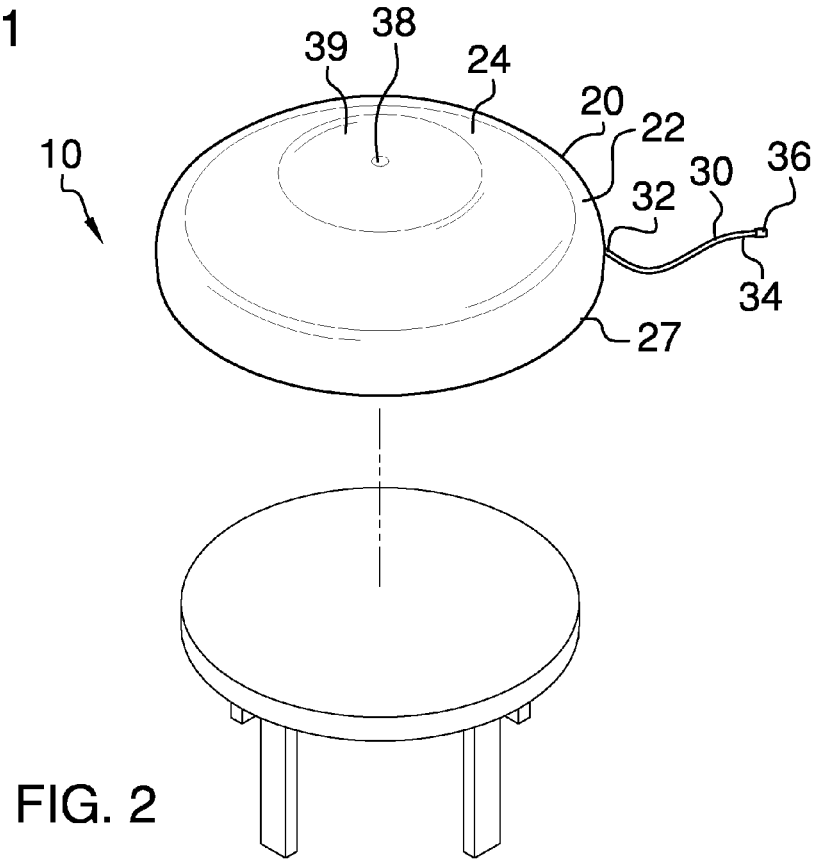
FIG. 2 is an exploded in-use view.
Figure 3:
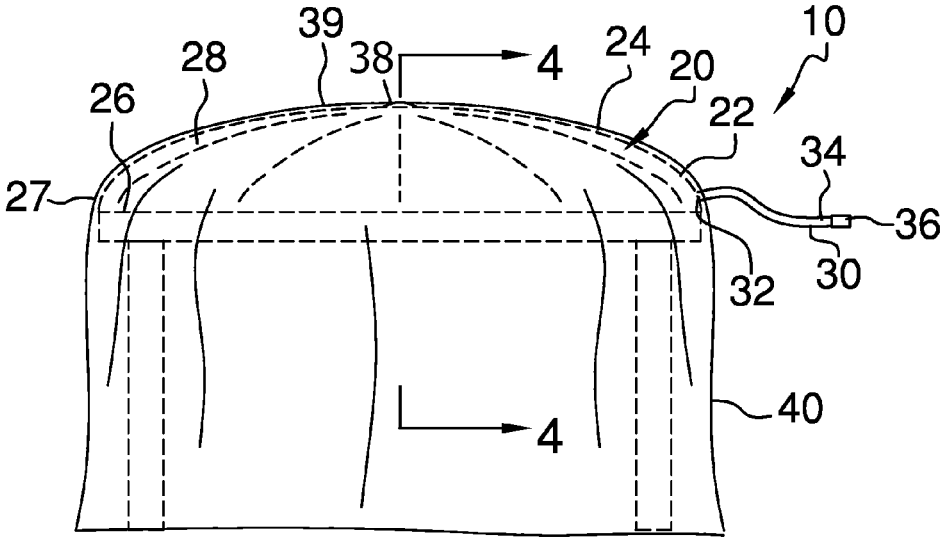
FIG. 3 is an in-use front elevation view.
Figure 4:
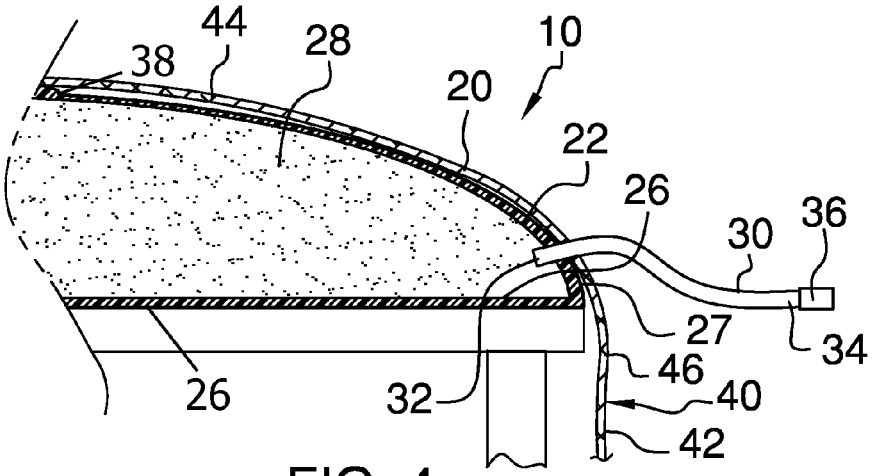
FIG. 4 is a cross-sectional view taken along line 4-4 of FIG. 3
Figure 5:
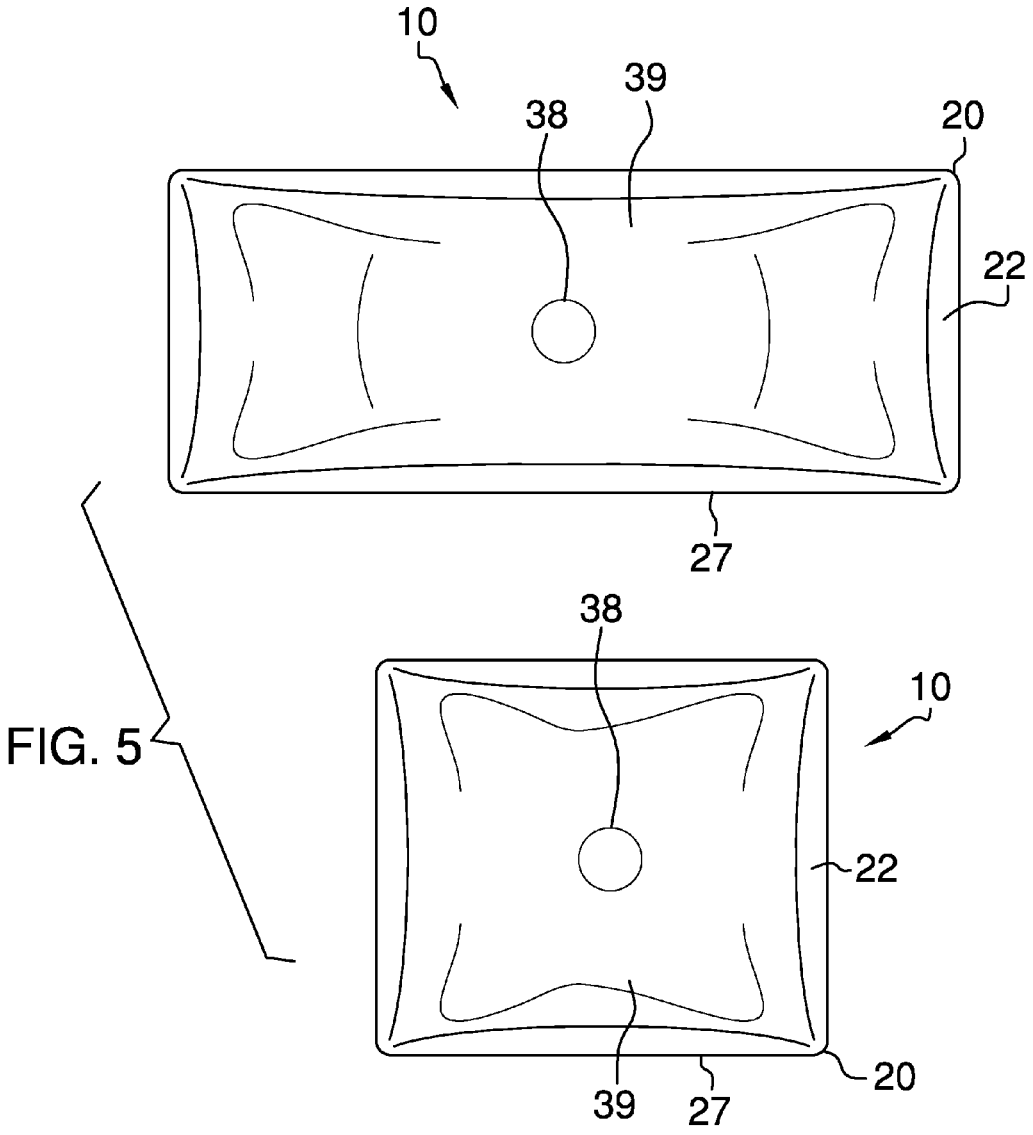
FIG. 5 is a top plan view.

Referring to FIGS. 1 through 5 the present inflatable furniture cover support 10 is illustrated. The inflatable furniture cover support 10 is devised to be used in combination with a furniture cover 40 as described herein or a cover already possessed by a user. The inflatable furniture cover support 10 includes an inflatable shell 20. The inflatable shell 20 includes a continuous airtight outer body 22. The outer body 22 has a top side 24, a closed flat bottom side 26, and a continuous outer perimeter 27 disposed therebetween. An inflatable air chamber 28 is continuously disposed within the outer body 22. The outer body 22 top side 24 has a size and a shape configured to cover only an entire top surface of an exposed horizontal portion of the outdoor furniture item. The outer body 22 bottom side 26 is removably disposed atop the top surface. The outer body 22 bottom side 26 further has a size extending from a center portion of the top surface to proximal an outer perimeter of the top surface. The outer body 22 bottom side 26 is configured to substantially conform to the top surface of the exposed horizontal portion of the outdoor furniture item. The air intake-exhaust tube 30 has a proximal end 32 in fluid communication with the air chamber 28 and further having a distal end 34. The shell 20 is one of a dome-shape as shown in FIGS. 1 through 3, a rectangular shape, and a square shape, as shown in FIG. 5.

An air intake-exhaust valve 36 is disposed on the distal end 34 of the tube 30. The valve 36 is in operational communication with an air supply source, such as a manual foot air pump or an electric pump. The valve 36 is configured to permit air flow into the tube 30 and the air chamber 28 to inflate the shell 20 and alternately to permit air flow from the air chamber 28 and the tube 30 to deflate the shell 20. A grip member 38 of the outer body 22 is centrally disposed on the top side 24. The grip member 38 is configured to accommodate removal of the outer body 22 from the top surface. The outer body 22 has a center portion 39 centrally disposed therein directly adjacent the top side 24. The center portion 39 of the outer body 22 surrounds the grip member 38. The center portion 39 has a height of approximately 12 inches.

A furniture cover 40 can also be provided to work in conjunction with the shell 20, although a user can, instead, employ a cover that the user already possesses. The furniture cover 40 includes a waterproof, mildew resistant furniture cover body 42. The cover body 42 has an upper portion 44 disposed on the top side 24 of the outer body 22 and a lower portion 46 having a size and a shape configured to cover an exposed side of a vertical portion of the outdoor furniture item. The shell 20 is configured to support the furniture cover 40 in a position covering the outdoor furniture item without touching the outdoor furniture item to prevent mildew and water stains on the furniture cover 40.

What is claimed is:

1. An inflatable furniture cover support in combination with a furniture cover consisting of:

an inflatable shell comprising:

a continuous airtight outer body having a top side, a closed flat bottom side, and a continuous outer perimeter disposed therebetween;

an inflatable air chamber continuously disposed within the outer body between the top side, the closed flat bottom side, and the outer perimeter;

a center portion of the outer body centrally disposed therein directly adjacent the top side;

wherein the outer body top side has a size and a shape configured to cover only an entire top surface of an exposed horizontal portion of the outdoor furniture item;

wherein the outer body bottom side is removably disposed atop the top surface, wherein the outer body bottom side further has a size extending from a central portion of the top surface to proximal an outer perimeter of the top surface, wherein the outer body bottom side is configured to substantially conform to the top surface of the exposed horizontal portion of the outdoor furniture item;

an air intake-exhaust tube having a proximal end in fluid communication with the air chamber and further having a distal end; and an air intake-exhaust valve disposed on the distal end of the tube, the valve in operational communication with an air supply source, wherein the valve is configured to permit air flow into the tube and the air chamber to inflate the shell and alternately to permit air flow from the air chamber and the tube to deflate the shell;

a grip member of the outer body centrally disposed on the center portion;

wherein the grip member is configured to accommodate removal of the outer body from the top surface;

wherein the center portion of the outer body surrounds the grip member in a position directly adjacent the top side;

wherein the shell is one of a dome-shape, a rectangular shape, and a square shape; and a furniture cover comprising a waterproof, mildew resistant furniture cover body having an upper portion disposed on the top side of the outer body and a lower portion having a size and a shape configured to cover an exposed side of a vertical portion of the outdoor furniture item;

wherein the shell is configured to support the furniture cover and, alternately a cover possessed by a user to cover the outdoor furniture item, in a position covering the outdoor furniture item without touching the outdoor furniture item.

2. An inflatable furniture cover support comprising:

an inflatable shell comprising:

a continuous airtight outer body having a top side, a closed flat bottom side, and a continuous outer perimeter disposed therebetween;

an inflatable air chamber continuously disposed within the outer body between the top side, the closed flat bottom side, and the outer perimeter;

a center portion of the outer body centrally disposed therein directly adjacent the top side;

wherein the outer body top side has a size and a shape configured to cover only an entire top surface of an exposed horizontal portion of the outdoor furniture item;

wherein the outer body bottom side is removably disposed atop the top surface, wherein the outer body bottom side further has a size extending from a central portion of the top surface to proximal an outer perimeter of the top surface, wherein the outer body bottom side is configured to substantially conform to the top surface of the exposed horizontal portion of the outdoor furniture item;

an air intake-exhaust tube having a proximal end in fluid communication with the air chamber and further having a distal end; and an air intake-exhaust valve disposed on the distal end of the tube, the valve in operational communication with an air supply source, wherein the valve is configured to permit air flow into the tube and the air chamber to inflate the shell and alternately to permit air flow from the air chamber and the tube to deflate the shell;

a grip member of the outer body centrally disposed on the center portion of the outer body, the center portion of the outer body surrounding the grip member in a position directly adjacent the top side;

wherein the grip member is configured to accommodate removal of the outer body from the top surface;

wherein the shell is configured to support a furniture cover and, alternately a cover possessed by a user to cover the outdoor furniture item, in a position covering the outdoor furniture item without touching the outdoor furniture item.

3. The inflatable furniture cover support of claim 2 wherein the shell is one of a dome-shape, a rectangular shape, and a square shape.

* * * * *